US010138681B2

(12) United States Patent
Crawford

(10) Patent No.: US 10,138,681 B2
(45) Date of Patent: Nov. 27, 2018

(54) LADDER TIE OFF SYSTEM

(71) Applicant: John Crawford, Fulton, SD (US)

(72) Inventor: John Crawford, Fulton, SD (US)

( * ) Notice: Subject to any disclaimer, the term of this patent is extended or adjusted under 35 U.S.C. 154(b) by 179 days.

(21) Appl. No.: 15/238,346

(22) Filed: Aug. 16, 2016

(65) Prior Publication Data

US 2018/0051515 A1 Feb. 22, 2018

(51) Int. Cl.
*E06C 7/18* (2006.01)
*E06C 7/48* (2006.01)

(52) U.S. Cl.
CPC ..... *E06C 7/188* (2013.01); *E06C 7/48* (2013.01)

(58) Field of Classification Search
CPC ..... E06C 7/188; E06C 7/48
See application file for complete search history.

(56) References Cited

U.S. PATENT DOCUMENTS 3,037,579 A * 6/1962 Barrow ..... E06C 1/34 182/107
3,678,542 A * 7/1972 Prete, Jr. ..... B60P 7/0823 24/170
3,792,756 A * 2/1974 Kelly ..... E06C 7/48 182/107
3,972,756 A 8/1976 Nagase et al.
4,601,364 A * 7/1986 York ..... A01M 31/02 108/152
4,660,794 A * 4/1987 Given ..... E06C 7/188 182/120
4,792,016 A 12/1988 Ingalsbe et al.
5,067,588 A * 11/1991 Bendickson ..... E06C 1/34 182/107
5,484,036 A * 1/1996 Cothern ..... E06C 1/34 182/107
5,779,001 A * 7/1998 Skyba ..... E06C 1/381 182/107
5,896,945 A 4/1999 Boelling
5,950,972 A * 9/1999 Irish ..... E06C 7/14 182/121
7,367,425 B2 5/2008 Rivers et al.
7,575,097 B2 * 8/2009 Sheridan ..... E06C 1/34 182/107
7,753,170 B1 * 7/2010 Gibson ..... E06C 7/14 182/107
8,381,877 B1 * 2/2013 Freund ..... E06C 1/10 182/116

(Continued)

FOREIGN PATENT DOCUMENTS

CN 204728982 10/2015
DE 4142750 7/1992

(Continued)

*Primary Examiner* — Colleen M Chavchavadze

(57) ABSTRACT

A ladder tie off system incorporates a safety strap into a ladder for securing the ladder to prevent undesired tipping. The system includes a ladder having a pair of lateral side members and a plurality of rungs extending between the lateral side members. A extendable tether includes a tensioning mechanism, a fixed section, and an extendable section. A mount is coupled to the tensioning mechanism of the extendable tether. The mount is coupled to the ladder proximate a top end of the ladder wherein the extendable tether is configured for is secured to a static object near the top of the ladder whereby the ladder is inhibited from tipping during use.

4 Claims, 5 Drawing Sheets

(56) References Cited

U.S. PATENT DOCUMENTS

| | | | | |
|---|---|---|---|---|
| 8,997,932 | B1 * | 4/2015 | Ochoa | E06C 7/48 182/116 |
| 2002/0108811 | A1 * | 8/2002 | Ulmschneider | E06C 1/34 182/206 |
| 2003/0188924 | A1 | 10/2003 | Bamber | |
| 2013/0025969 | A1 | 1/2013 | Horn | |
| 2014/0131532 | A1 * | 5/2014 | Elmore | E06C 7/48 248/201 |

FOREIGN PATENT DOCUMENTS

| | | | | |
|---|---|---|---|---|
| EP | 3002407 | B1 * | 3/2017 | E06C 7/188 |
| JP | 2000038887 | | 2/2000 | |
| JP | 2002309880 | | 10/2002 | |

* cited by examiner

LADDER TIE OFF SYSTEM

BACKGROUND OF THE DISCLOSURE

Field of the Disclosure

The disclosure relates to ladder safety devices and more particularly pertains to a new ladder safety device for incorporating a safety strap into a ladder for securing the ladder to prevent undesired tipping.

SUMMARY OF THE DISCLOSURE

An embodiment of the disclosure meets the needs presented above by generally comprising a ladder having a pair of lateral side members and a plurality of rungs extending between the lateral side members. A extendable tether includes a tensioning mechanism, a fixed section, and an extendable section. A mount is coupled to the tensioning mechanism of the extendable tether. The mount is coupled to the ladder proximate a top end of the ladder wherein the extendable tether is configured for is secured to a static object near the top of the ladder whereby the ladder is inhibited from tipping during use.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
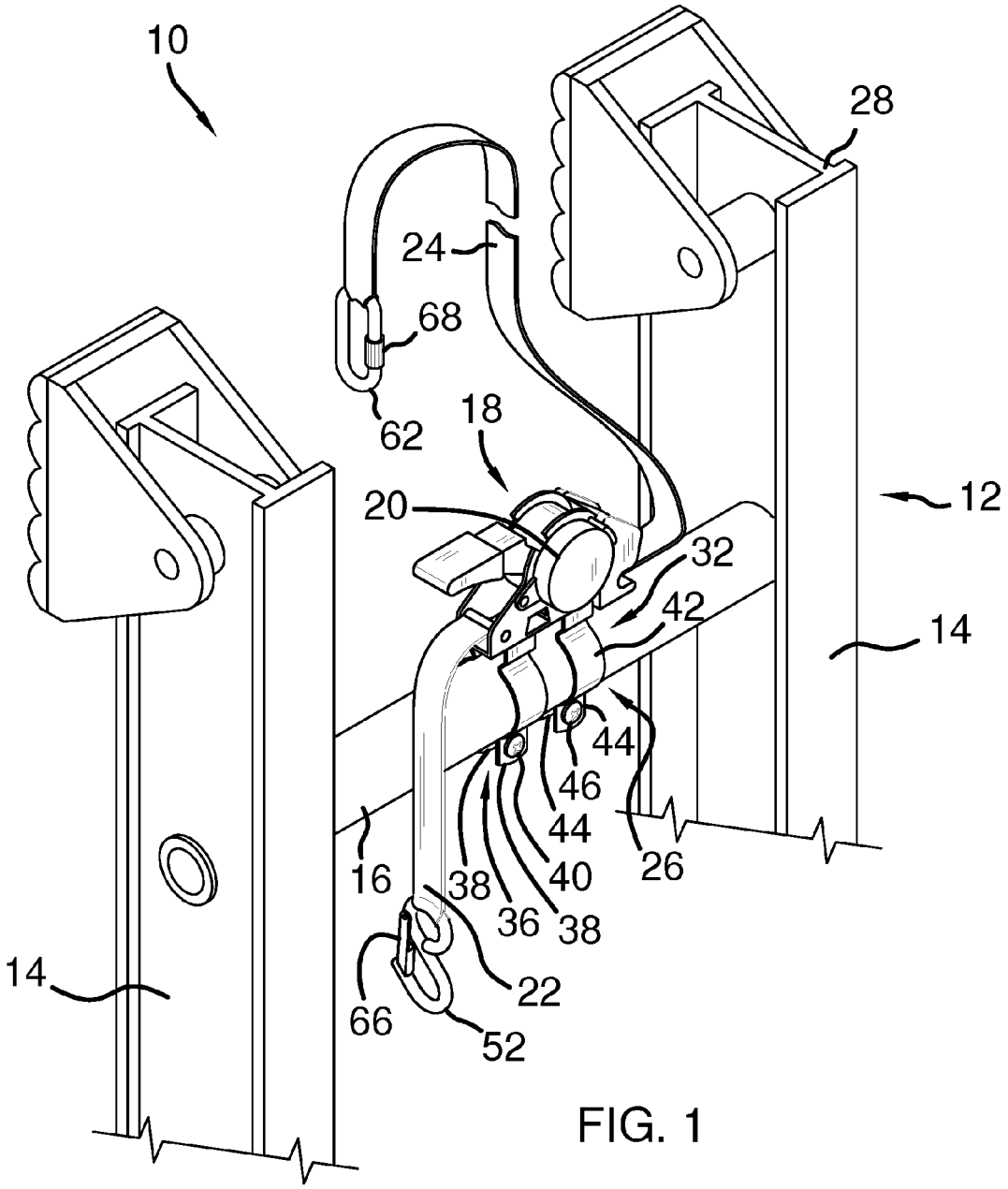
FIG. 1 is a top front side perspective view of a ladder tie off system according to an embodiment of the disclosure.

With reference now to the drawings, and in particular to FIGS. 1 through 5 thereof, a new ladder safety device embodying the principles and concepts of an embodiment of the disclosure and generally designated by the reference numeral 10 will be described.

As best illustrated in FIGS. 1 through 5, the ladder tie off system 10 generally comprises a ladder 12. The ladder 12 has a pair of lateral side members 14 and a plurality of rungs 16 extending between the lateral side members 14. An extendable tether 18 includes a tensioning mechanism 20, a fixed section 22 coupled to the tensioning mechanism 20, and an extendable section 24 coupled to the tensioning mechanism 20. The extendable tether 18 is shown as a ratchet strap which works in a conventional manner. The extendable tether can also comprise line, rope, chain, or the like. A mount 26 is coupled to the tensioning mechanism 20 of the extendable tether 18. The mount 26 is coupled to the ladder 12 proximate a top end 28 of the ladder 12 wherein the extendable tether 18 is configured for being secured to a static object 30 or anchor near the top end 28 of the ladder 12. Thus, the ladder 12 is inhibited from tipping during use.

Figure 2:
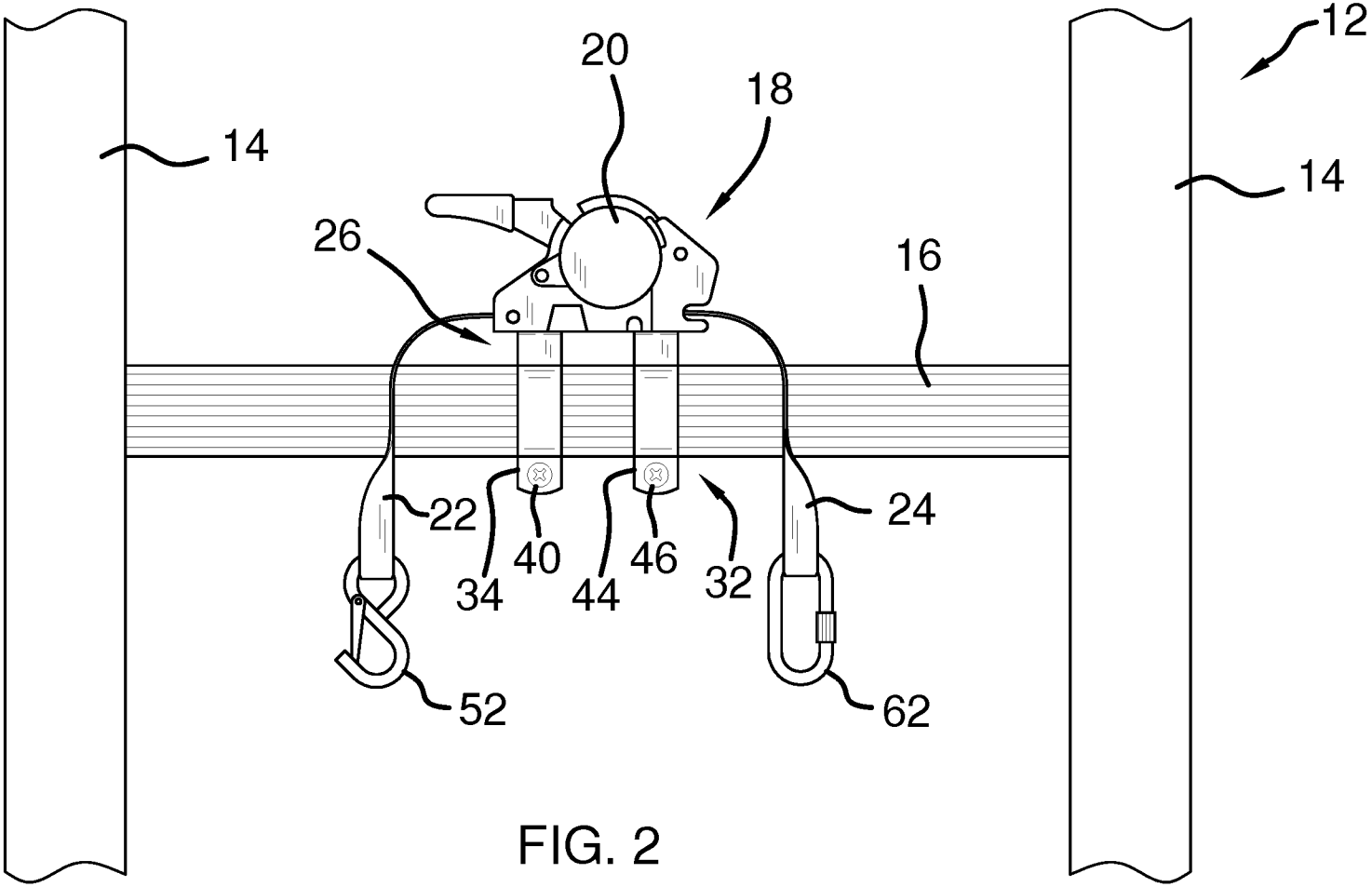
FIG. 2 is a front view of an embodiment of the disclosure.

In an embodiment shown more particularly in FIGS. 1 and 2, the mount 26 comprises a clamp 32. The clamp 32 is secured to one of the plurality of rungs 16. The clamp 32 further includes a ring 34. The ring 34 has a break 36 therein defining an opening into the ring 34. Each of a pair of connection flanges 38 extends outwardly from the ring 34 on opposite sides of the break 36. A fastener 40, such as a nut and bolt or the like, is extended through the connection flanges 38 such that the fastener 40 urges the connection flanges 38 together whereby the ring 34 is frictionally engaged to one of the plurality of rungs 16. The clamp 32 may include a second ring 42 spaced from the first ring 34, having similar structure including connection flanges 44 fastened by a second fastener 46.

Figure 3:
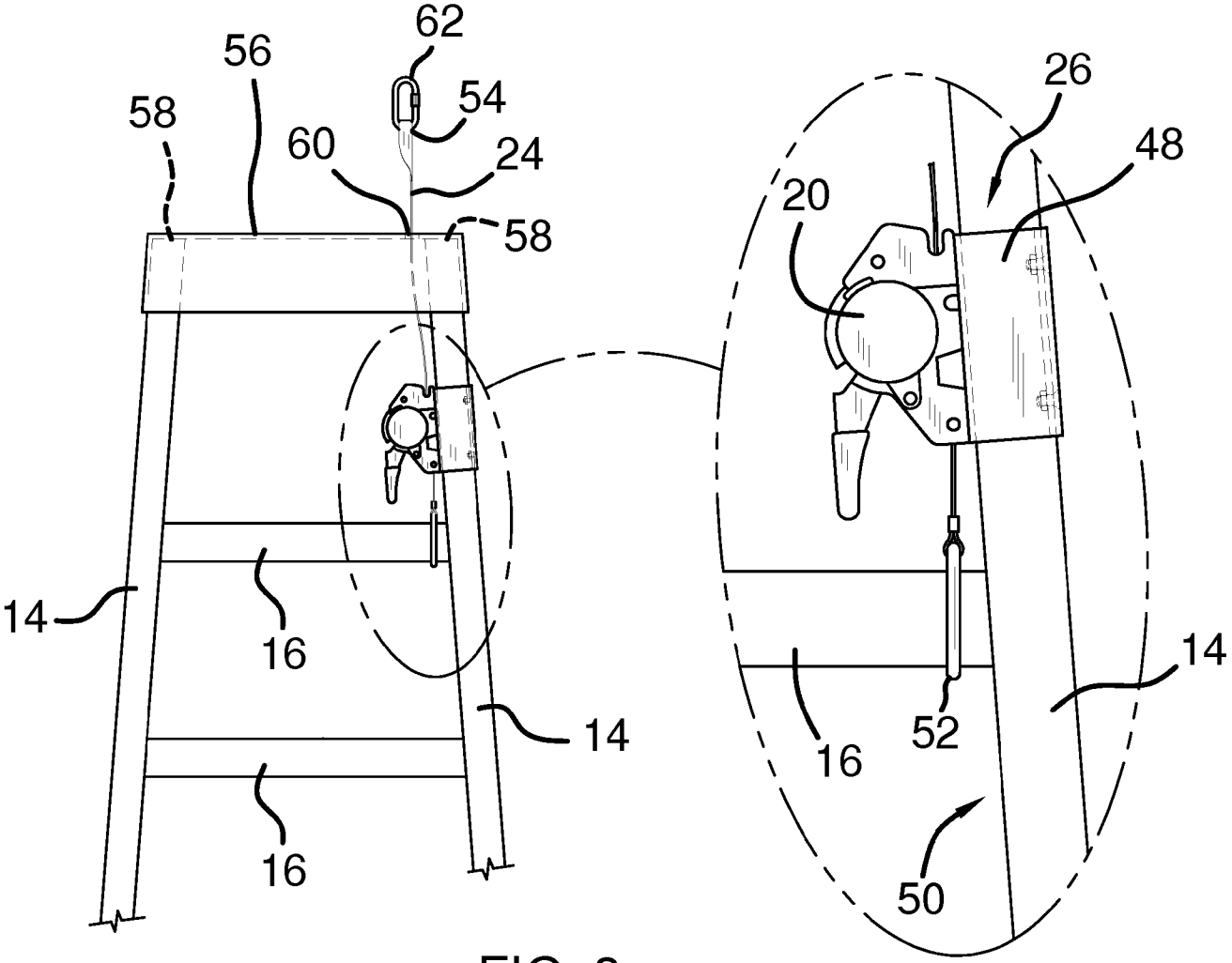
FIG. 3 is a side and detailed view of an embodiment of the disclosure.

In embodiments shown in FIGS. 3 through 6, the mount 26 comprises a bracket 48 attached to the ladder 12. The bracket 48 is positioned on one of the lateral side members 14 of the ladder 12. The bracket 48 is positioned such that the tensioning mechanism 20 of the extendable tether 18 is positioned on an interior surface 50 of the one of the lateral side members 14 of the ladder 12 adjacent to one of the plurality of rungs 16 of the ladder 12. A fixed end hook 52 is coupled to a free end 54 of the fixed section 22. The fixed end hook 52 engages the one of the plurality of rungs 16 of the ladder 12 adjacent to the tensioning mechanism 20. The fixed end hook 52 is a safety hook having a conventional biased arm 66 which prevents unintended disengagement of the fixed end hook 52 from a rung 16 of the ladder 12. In this embodiment, as shown in FIG. 3, the ladder 12 may have a top member 56 extending between aligned ends 58 of the lateral side members 14. A slot 60 extends through the top member 56. The extendable section 24 passes through the slot 60 in the top member 56. An extendable end link 62 is coupled to the extendable section 24. The extendable end link 62 has a threaded collar 68 for opening and closing the extendable end link 62 to provide secure engagement and prevent unintended disengagement from the static object 30.

Figure 4:
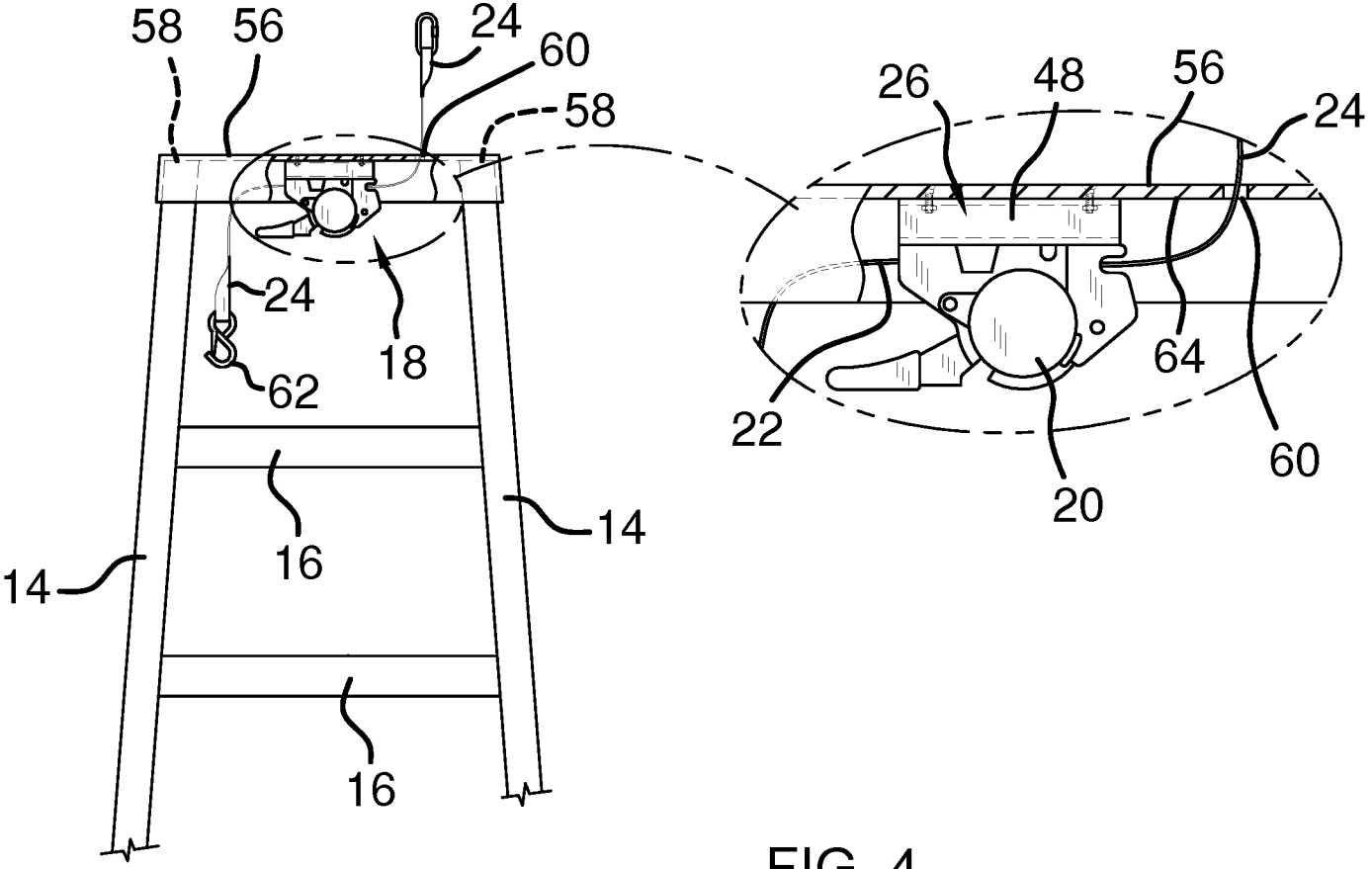
FIG. 4 is a front and detailed view of an embodiment of the disclosure.
Figure 5:
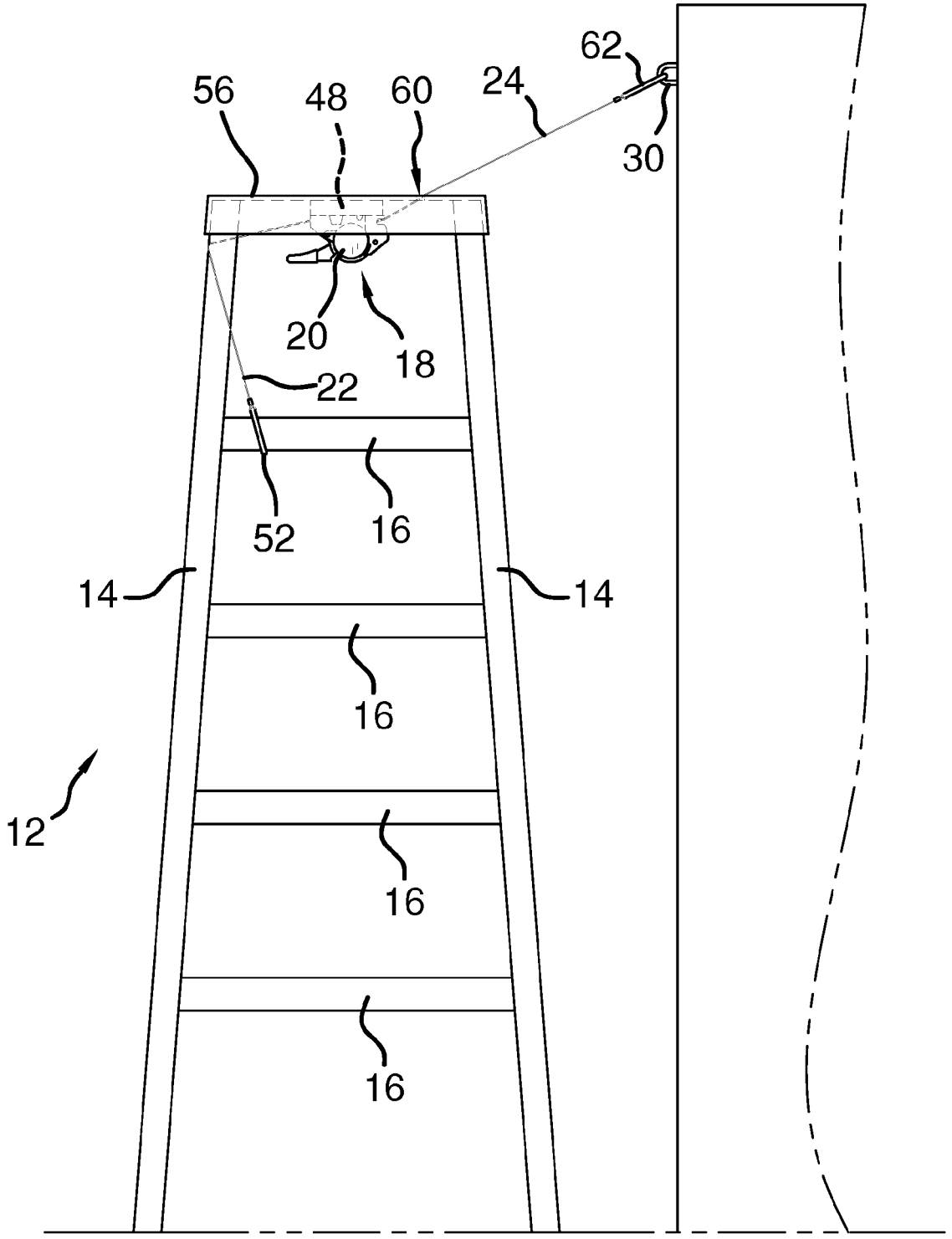
FIG. 5 is a front view of an embodiment of the disclosure.

In an embodiment shown more particularly in FIGS. 4 and 5, the ladder 12 has the top member 56 extending between aligned ends 58 of the lateral side members 14. The mount 26 is attached to the top member 56. More specifically, the mount 26 is positioned on an underside 64 of the top member 56 facing a topmost one of the plurality of rungs 16 of the ladder 12. The slot 60 extends through the top member 56 and the extendable section 24 passes through the slot 60 in the top member 56. The fixed section 22 is wrapped around one of the lateral side members 14 and the fixed end hook 52 is engaged to one of the plurality of rungs 16 of the ladder 12.

In use, the ladder 12 is positioned as desired. The extendable section 24 is extended and either fastened directly to an anchor or wrapped around the anchor and fastened back to the ladder, itself, or another stable object to secure the position of the ladder 12 as desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ladder tie off system comprising:

a ladder, said ladder having a pair of lateral side members and a plurality of rungs extending between said lateral side members;

an extendable tether, said extendable tether including a tensioning mechanism, a fixed section coupled to said tensioning mechanism, and an extendable section coupled to said tensioning mechanism;

a mount, said mount being coupled to said tensioning mechanism of said extendable tether, said mount being coupled to said ladder proximate a top end of said ladder wherein said extendable tether is configured for being secured to a static object near said top of said ladder whereby said ladder is inhibited from tipping during use;

said ladder having a top member extending between aligned ends of said lateral side members;

said mount being attached to said top member, said mount being positioned on an underside of said top member facing a topmost one of said plurality of rungs of said ladder;

a slot extending through said top member, said extendable section passing through said slot in said top member;

a fixed end hook being coupled to a free end of said fixed section; and said fixed section being wrapped around one of said lateral side members and said fixed end hook being engaged to one of said plurality of rungs of said ladder.

2. A ladder tie off system comprising:

a ladder, said ladder having a pair of lateral side members and a plurality of rungs extending between said lateral side members, said ladder having a top member extending between aligned ends of said lateral side members;

an extendable tether, said extendable tether including a tensioning mechanism, a fixed section coupled to said tensioning mechanism, and an extendable section coupled to said tensioning mechanism;

a mount, said mount being coupled to said tensioning mechanism of said extendable tether, said mount being coupled to said ladder proximate a top end of said ladder wherein said extendable tether is configured for being secured to a static object near said top of said ladder whereby said ladder is inhibited from tipping during use, said mount comprising a bracket attached to said ladder, said mount being attached to said top member, said mount being positioned on an underside of said top member facing a topmost one of said plurality of rungs of said ladder;

a slot extending through said top member; and said extendable section passing through said slot in said top member.

3. The device of claim 2, further comprising:

a fixed end hook being coupled to a free end of said fixed section; and said fixed section being wrapped around one of said lateral side members and said fixed end hook being engaged to one of said plurality of rungs of said ladder.

4. The system of claim 2, further comprising said slot being parallel to each of said lateral side members of said ladder.

* * * * *